US006666966B1

(12) United States Patent
Schluttig

(10) Patent No.: US 6,666,966 B1
(45) Date of Patent: Dec. 23, 2003

(54) SELF-DISINFECTING DRAIN TRAP IN DRAINAGE CHANNELS

(76) Inventor: Alexander Schluttig, Nordstrasse 8, D-02991 Lauta (DE)

( * ) Notice: Subject to any disclaimer, the term of this patent is extended or adjusted under 35 U.S.C. 154(b) by 0 days.

(21) Appl. No.: 09/936,318

(22) PCT Filed: Sep. 14, 2000

(86) PCT No.: PCT/DE99/00678

§ 371 (c)(1),
(2), (4) Date: Jun. 26, 2002

(87) PCT Pub. No.: WO00/53857

PCT Pub. Date: Sep. 14, 2000

(51) Int. Cl.[7] ..... E03C 1/126

(52) U.S. Cl. ..... 210/163; 210/184; 210/748; 4/222; 4/668; 4/677

(58) Field of Search ..... 210/163, 164, 210/175, 184, 186, 748; 4/222, 668, 679

(56) References Cited

U.S. PATENT DOCUMENTS

| | | | | | |
|---|---|---|---|---|---|
| 2,452,367 | A | * | 10/1948 | Gangloff | 4/222 |
| 3,175,567 | A | | 3/1965 | Crawford | 134/169 |
| 4,192,988 | A | | 3/1980 | Pederson et al. | 219/201 |
| 4,502,164 | A | * | 3/1985 | Gemmell | 210/175 |
| 4,893,361 | A | * | 1/1990 | Burns | 4/679 |
| 5,940,894 | A | * | 8/1999 | Cruz | 4/222 |
| 6,491,814 | B1 | * | 12/2002 | Wheeler | 210/164 |

FOREIGN PATENT DOCUMENTS

| | | | |
|---|---|---|---|
| DE | 2747992 | 5/1978 | E03C/1/28 |
| DE | 4025078 A1 | 2/1992 | B01J/19/12 |
| DE | 4206901 A | 9/1993 | E03C/1/126 |
| DE | 4224445 A1 | 1/1994 | E03C/1/126 |
| DE | 29509210 U1 | 8/1995 | A61L/2/10 |
| GB | 1417711 | 12/1975 | E03C/1/28 |

* cited by examiner

*Primary Examiner*—Christopher Upton
(74) *Attorney, Agent, or Firm*—Nash and Titus, LLC

(57) ABSTRACT

The self-disinfecting drain trap is an arrangement for the automatic cleaning and disinfecting of drain traps in drain channels. The cleaning and disinfection take place automatically during normal usage and without interruption of the operation of the drain trap. They take place by means of a novel combination for drain traps of electromechanical oscillation, preferably ultrasound, heating the interior space of the drain trap and heating the confining liquid and preventing growth on the inner wall by means of a growth-inhibiting and antimicrobially effective coating. The danger of recontamination of sanitary apparatuses and devices and therewith also of the ambient air by microorganisms from wastewater pipelines is effectively countered therewith.

14 Claims, 5 Drawing Sheets

SELF-DISINFECTING DRAIN TRAP IN DRAINAGE CHANNELS

This is a national phase application based on WO 00/53857 (PCT/DE99/00678), filed on Sep. 14, 2000.

FIELD OF THE INVENTION

The invention describes an arrangement for the automatic cleaning and disinfection of drain traps in drain channels. The cleaning and disinfection take place automatically during normal usage and without interrupting the operation of the drain trap. They take place by means of a combination, novel for drain traps, of electromechanical oscillation, of low-frequency oscillations up to ultrasonic irradiation, heating of the inner area of the drain trap and of the confining or sealing liquid and by preventing growth on the inner wall by means of a growth-inhibiting and antimicrobially efficacious coating.

BACKGROUND OF THE INVENTION

The danger of a microbic recontamination of sanitary apparatuses and devices and therewith also of the air in the room by microorganisms from drain channels has long been known and feared, particularly in the clinical area; however, it presents a general hygienic problem in areas of common usage of sanitary devices.

Drain channels with zones of low or sharply fluctuating flowthrough rate such as, e.g., drain traps integrated in them in which traps waste water functions at the same time as drain-trap medium are, as is known, places where microorganisms reside and multiply. At times, optimal preconditions for the survival and multiplication of germs dangerous to health prevail in drain traps. The microbial recontamination of sanitary devices (e.g., washbasins) and of room air takes place in the following manner:

When liquid impacts and becomes turbulent, aerosols are produced consisting of minute droplets of liquid that also contain all microorganisms contained in the confining liquid. Such aerosols are produced, e.g., when water cocks of washbasins are opened in the drain area. These aerosols then contain representatives of all of the microorganisms present in the liquid in the siphon and present in the slime layers adhering to the inner walls.

The aerosols formed are displaced by subsequent water flowing out of the hollow area in the direction of the pipeline or channel entrance and therefore pass into the air of the room from which the waste water was placed into the pipeline. In this manner, e.g., these bacteria can be transferred onto the hands of a person washing up in the washbasin.

This, for its part, results in the sufficiently known and frequently described hygienic problems, especially in infection stations of hospitals, particularly as regards the feared bacterium *Pseudomonas aeruginosa*.

Moreover, microbes form the known, slimy coating together with dirt particles on the inner wall of the pipeline or of the siphon. This coating grows, largely invisible to the eye at times, out of the opening of the drain into the washbasin.

The prevention of the adhering of microorganisms and dirt particles on the inner walls of drain traps and the simultaneous killing of microorganisms in drain traps is an important problem that has, however, not been technically solved up to the present day, especially as regards the dangerous occurrence of antibiotic-resistant microorganisms such as the bacterium *Pseudomonas aeruginosa*, that is extremely feared in the clinic.

Developments for drain channels and siphons have been described that make use of the germicidal properties of high temperature (DE 4206901, U.S. Pat. No. 4,192,988), ultraviolet radiation in liquids (DE 4206901, DE 4025078 A1, DE 29509210 U1). Developments for cleaning and disinfecting siphons and pipelines with ultrasound are also known (DE 27 47 992 A1, U.S. Pat. No. 3,175,567).

The combination of ultraviolet light and ultrasound (DE 295 09 210 U1) is not described for the cleaning and disinfecting of pipelines and siphons but is described for the cleaning and disinfecting of objects in liquids. The combination of ultraviolet light and high temperature (DE 42 06 901 A1) is described for treating liquid in a siphon.

The combination of the effect of electromechanical oscillations, in particular ultrasound with elevated temperature has not yet been described for drain traps.

All known inventions take into account partial aspects of the total events in a pipeline or a siphon and offer solutions for them.

These partial solutions have such disadvantages in practice that up to the present none of the solutions has found acceptance in clinics even though many application tests have been carried out with these systems, some even over a rather long time period.

The sole use of high temperatures for long time periods results, as a consequence of the drying of dirty water occasioned by evaporation, in augmented coatings of the inner walls of pipelines and siphons.

The drain traps clog up and lose their function. In the approach area the dry wall coating is altematingly re-moistened by subsequent water flowing in and constitutes a very good path for recontamination. In addition, high evaporation losses and incrustations can suppress the operation of the drain trap or clog the pipeline. However, the killing of pathogenic germs is not assured until at temperatures that significantly advance the evaporation of the liquid and therewith the wall coating.

The effectiveness of the use of ultraviolet light in liquids is very much a function of the degree of contamination of the drain [waste] water and of the penetration (transmission) conditioned by it. In addition, a few, in particular pathogenic germs such as, e.g., legionellas can not be reached or are difficult to kill with UV irradiation alone.

The -effect of high temperature and ultraviolet light can result in an insufficient killing of germs, especially in the case of highly contaminated and possibly infectious liquids like those usually found in clinical practice on account of a low penetration capability and can also not prevent the growth on walls and therewith recontamination via this path. The effectiveness of ultrasound on the killing of germs is temperature-dependent. Since the temperature of the liquid in pipelines and drain traps is a function of many factors and therefore fluctuates, the killing effect by ultrasound alone also fluctuates and can therefore not be completely defined even in the case of maximum acoustic irradiation.

At room temperature, for example, the killing effect in the case of logically installable ultrasound outputs (e.g., 300–1000 watts/liter) is possible only given relatively long irradiation times (one hour and longer) whereas at temperatures of 50° C. already a few minutes are sufficient. At this temperature there is still no killing of microorganisms by the heat alone.

Moreover, it is necessary in practice to carry out the irradiation at intervals and to keep the irradiation time as short as possible thereby. On the other hand, economy and the noise level require the installation of the lowest possible ultrasound intensities. The irradiation at intervals of the inner space of the drain trap results, especially at rather high temperatures, in the loosening of existing wall coatings and prevents a new coating at the same time.

SUMMARY OF THE INVENTION

The present invention entails a self-disinfecting drain trap that solves the problem of the multiplication and exiting of microorganisms from drain pipelines with reliability and reproducibility not available with the current state of the art by the maximum and consistently reproducible killing of germs, preventing the growth on the inner walls of drain traps and the exiting of aerosols contaminated with living germs from pipelines and that does not exhibit the previously cited disadvantages of known developments.

Thus, the following effects are achieved in an apparatus by the self-disinfecting drain trap of the invention:

1. Microorganisms of all types are killed in a reproducible manner always under the same conditions at a sufficiently high temperature, sufficient ultrasound intensity and a treatment time assuring a complete killing of germs by the invention during its proper usage.

2. A settling of microorganisms and dirt particles and the multiplication of microorganisms is made significantly more difficult by a liquid-repelling and/or antimicrobially active coating of the inner wall of the drain trap.

3. The air in the inner space of the drain trap can be additionally disinfected by ultraviolet light.

4. The invention prevents the formation of the known coating of dirt and microorganisms by means of a special anti-adhering coating of the inner wall or by the use of suitable material for the reaction area.

5. The invention prevents microorganisms from settling on the siphon wall by means of low-frequency electromechanical oscillations and dissolves coatings already present during normal usage.

DETAILED DESCRIPTION OF THE INVENTION

Figure 1:
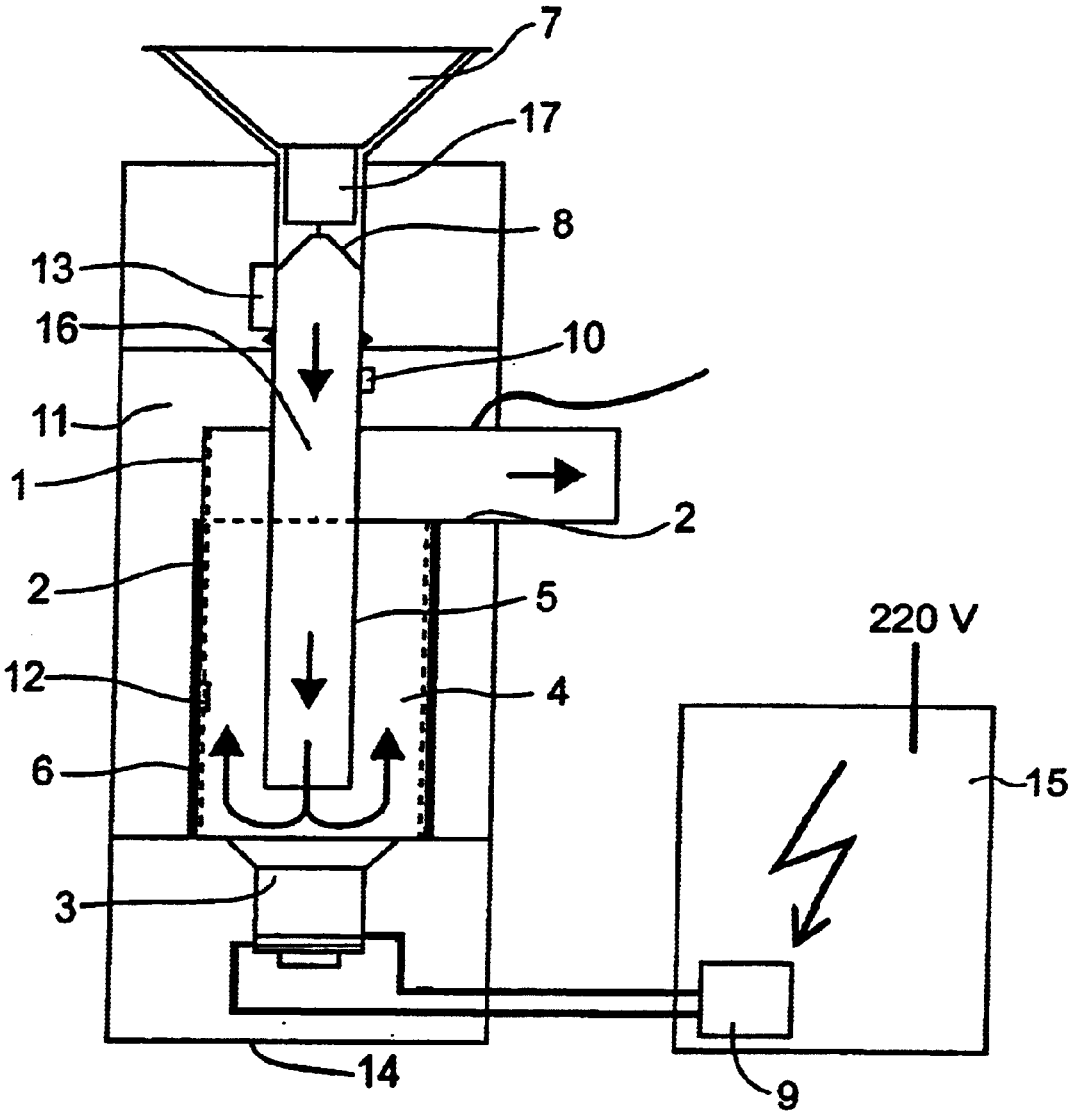
FIG. 1 shows the self-disinfecting drain trap in the form of a customary bottle cylindrical siphon, having maximal instrumentation and ultrasonic irradiation device.

The apparatus consists of a drain trap of known design 1 consisting of high-grade steel or other materials that can be provided with an anti-adhering coating 2, of at least one apparatus for ultrasonic irradiation 3 or for treatment with low-frequency electromechanical oscillations 3A, of liquid 4 in this space and of filling tube 5 with simultaneous temperature regulation or heating unit 6 extending into the liquid, consists of a coupling with a device for closing tube entrance opening 7, of closure membrane 8 and, selectively, of a device for treating air space 16 located above the confining liquid and treating closure membrane 8 with light, preferably ultraviolet light 13.

Deposits of dirt and of microorganisms are prevented inside the self-disinfecting drain trap and on its fittings with this combination. Germs which were carried in or grew in place are completely killed when ultrasound is used.

Figure 2:
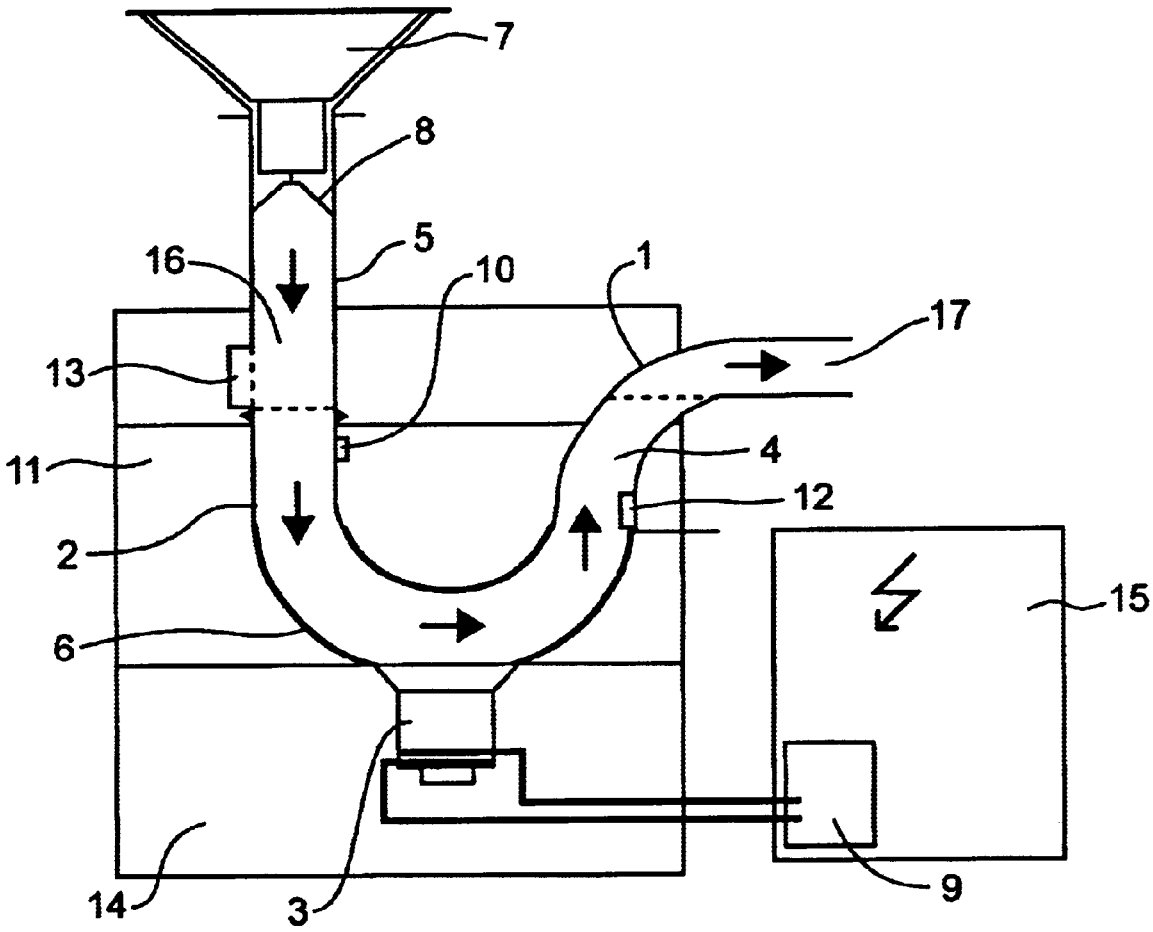
FIG. 2 shows another self-disinfecting drain trap in the form of a customary swan neck cylindrical siphon, having maximal instrumentation and ultrasonic irradiation device.
Figure 3:
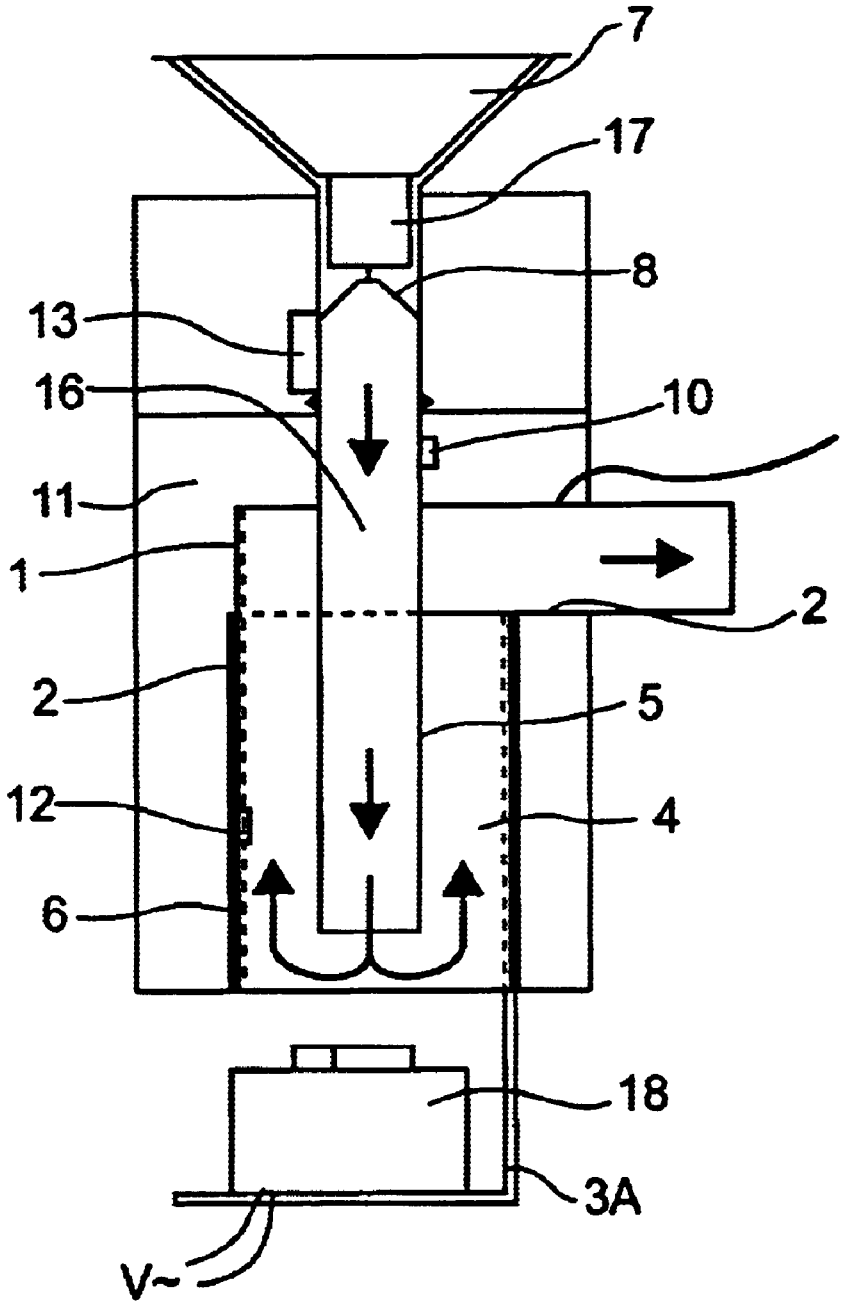
FIG. 3 shows the self-disinfecting drain trap apparatus in the form of a cylindrical siphon with maximal equipment and electromagnetic low frequency irradiation device.

The ultrasonic irradiation system consists according to FIGS. 1 and 2 of at least one ultrasound generator 9 and at least one ultrasound oscillator 3 that is either applied from the outside onto the drain trap or is introduced directly into the standing liquid. The low frequency irradiation system shown in FIGS. 3, 4 and 5 consists of at least one electromagnet 3A and a holder 18.

Liquid 4 located in the pipeline and the self-disinfecting drain trap is brought by a temperature regulation or heating unit system of any design 6 to a temperature optimal for killing microorganisms or for inhibiting the multiplication of germs and held at this temperature for at least the time of the ultrasonic or low frequency treatment. To this end at least one thermosensor 10 can be placed inside or outside the reaction area. The apparatus can be insulated against thermal radiation to the outside by insulating layer 11.

Temperature regulation (heating) system 6 can be installed outside or inside the reaction area.

Light source (preferably UV emitter) 13 can be installed in such a manner that the air space located over the confining layer and aerosols located in this air space are disinfected.

In order to assure the reliability of the method and of its operation, measuring sensors for temperature 10 and the level 12 of the confining liquid can be installed.

The entire apparatus is surrounded by external housing 14.

Switch cabinet 15 belongs to the apparatus.

The self-disinfecting drain trap can be provided with instruments of different complexities in accordance with the requirements resulting essentially from the type and the germ content of the waste water and the operating type of the drain trap.

According to the invention the self-disinfecting drain trap is always provided with at least one ultrasonic or low frequency irradiation device, at least one heating or thermostating device and with the associated control technology.

The following reference numbers refer to all Figures.

List of Reference Numerals

1=drain-trap body
2=anti-microbial anti-adhering coating
3=apparatus for ultrasonic irradiation, such as an ultrasonic oscillator
3A=electromagnet
4=confining fluid
5=filling tube
6=heating or thermostating unit
7=closure of the tube or pipeline opening
8=closure membrane
9=high-frequency generator
10=thermosensor
11=thermal insulation
12=level sensor
13=UV light emitter

14=housing
15=switch cabinet
16=outer air space above the confining liquid
17=drain tube of the drain trap
18=holder for electromagnet 3A Exemplary Embodiment 1

The self-disinfecting drain trap in FIG. 1 in the form of a customary bottle cylindrical siphon is designed with maximal instrumentation and ultrasonic device.

The self-disinfecting drain trap designed in this manner assures maximum reliability for all such drains used in an irregular manner and with which there is a danger of drying out in the intervals between use. The level control 12 is the main signal transmitter. That means that both the heating 6 and also the ultrasound 3 can only be operated given a sufficient level.

The heating capacity 6 can be installed at any level desired, as a result of which a very short heating-up phase can be achieved. The regulating of the thermostat avoids an exceeding of the temperature necessary for the acoustic irradiation even at the starting time of the heating prior to the ultrasonic treatment in the hot liquids located in the drain trap.

The closure (sealing) membrane 7 is fastened directly to the part of the mechanical opening mechanism extending into the drainpipe 17. The closure membrane consists of a membrane 7 of any desired material. This membrane is compressed in the middle by the liquid flowing into the drain. In the non-compressed state it separates the air space standing above the confining liquid 16 from the ambient air even when the drain trap is open.

Exemplary Embodiment 2

The self-disinfecting drain trap in FIG. 2 in the form of a customary swan necked siphon is designed with maximal instrumentation and ultrasonic device.

The self-disinfecting drain trap designed in this manner assures maximum reliability for all such drains used in an irregular manner and with which there is a danger of drying out in the intervals between use. The level control 12 is the main signal transmitter. That means that both the heating 6 and also the ultrasound 3 can only be operated given a sufficient level.

The heating capacity 6 can be installed at any level desired, as a result of which a very short heating-up phase can be achieved. The regulating of the thermostat avoids an exceeding of the temperature necessary for the acoustic irradiation even at the starting time of the heating prior to the ultrasonic treatment in the hot liquids located in the drain trap.

The mechanical membrane 7 closure is fastened directly to the part of the mechanical opening mechanism extending into the drainpipe 17. The closure membrane 7 consists of a membrane of any desired material. This membrane is compressed in the middle by the liquid flowing into the drain. In the non-compressed state it separates the air space standing above the confining liquid 16 from the ambient air even when the drain trap is open.

Exemplary Embodiment 3

This apparatus (not shown in the figures) corresponds essentially to FIG. 1 or 2, but has only minimal equipment, as only as much heating output via heating system 6 is installed so that no temperature regulation via a thermostat part is necessary because the temperature necessary for disinfecting is usually not exceeded or only exceeded in so limited a manner in time that significant evaporation losses can not arise. The heating system 6 and ultrasonic system 3 or electromagnet 3A are switched staggered in time. The heating system is cut in at first. When the time necessary for achieving the disinfecting temperature is attained, the heating 6 cuts off and the ultrasound 3 cuts in. The disinfecting temperature is achieved by designing the heating according to a certain, experimentally determined time. At this point in time the heating 6 is cut off and the ultrasound 3 cut in.

Exemplary Embodiment 4

Figure 4:
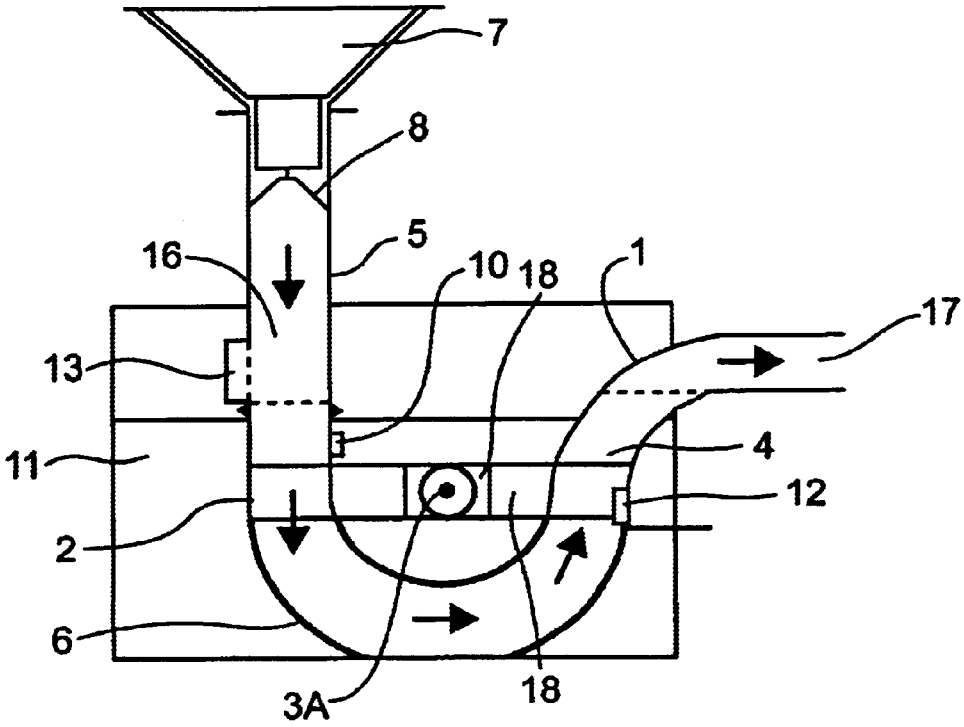
FIG. 4 shows another embodiment of the self-disinfecting drain trap apparatus in the form of a swan neck siphon with maximal instrumentation and electromagnetic low frequency device.

The apparatus as shown in FIG. 4 is functional in the following design with minimal equipment for self-cleaning and for killing microorganisms that are killed already at temperatures around approximately 60° C. (*Pseudomonas aeruginosa*) in the design with low-frequency electromechanical oscillation 3A.

Only as much heating output via temperature regulation or heating system 6 is installed so that no temperature regulation via a thermostat part is necessary because the temperature necessary for disinfecting is usually not exceeded or only exceeded in so limited a manner in time that significant evaporation losses can not arise. The heating system 6 and low-frequency acoustic irradiation system 3A are therefore switched staggered in time. Example: Heating on for 4×3 hours per 24 hours. Acoustic irradiation independently of the heating every 2 hours for 10 minutes at a time. This variant of an embodiment is provided with an antimicrobial inner coating 2.

Exemplary Embodiment 5

Figure 5:
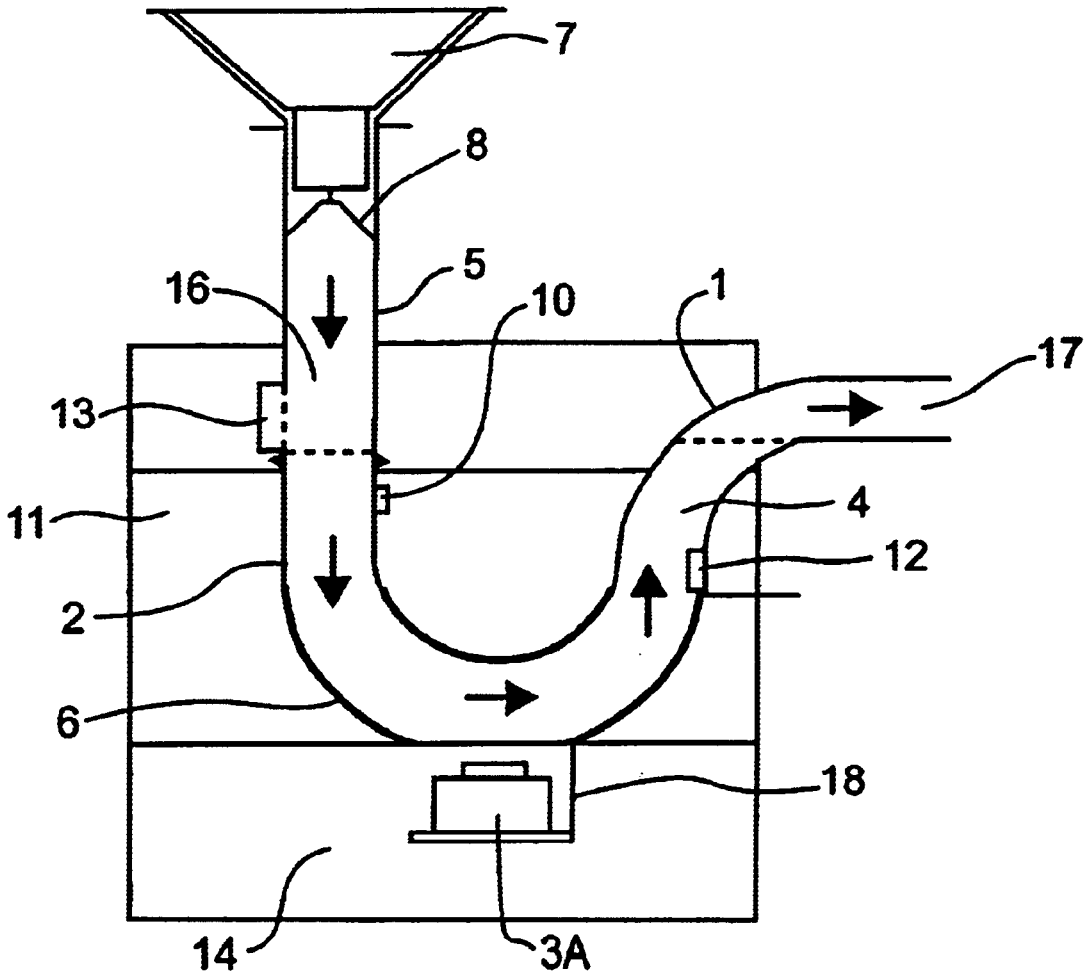
FIG. 5 illustrates another embodiment of the self-disinfecting drain trap apparatus.

Exemplary embodiment 5 of FIG. 5 is a self-disinfecting drain trap in the form of a customary bottle siphon with instrumentation with ultrasound, heating and thermal insulation.

In this variant the installed heating output is selected in such a manner that the confining liquid is heated either very rapidly (higher heating output) or slowly (low heating output).

In the case of the installation of a low heating output (approximately 0.1–0.3 watt/ml) a start is made from a minimum temperature of the confining liquid at the beginning of the heating. The temperature necessary for ultra-acoustic irradiation is achieved after a rather long time (30–60 minutes). The ultrasound 3 is then cut in at this time.

This arrangement is advantageous for drains used frequently and regularly into which liquids with rather high germ contents and rather low temperatures are introduced.

In the case of the installation of a high heating output (approximately 1–3 watts/ml confining liquid) the confining liquid attains temperatures in the vicinity of the boiling point of the confining liquid within a few minutes independently of the initial temperature. This temperature is maintained during the time of the ultra-acoustic irradiation, which can then be very short. The heating 6 and ultrasound 3 are cut in and out simultaneously. This arrangement kills particularly heat resistant spore-forming microorganisms in a very short time. Only a very short acoustic irradiation time is necessary for non-spore-forming bacteria and yeasts and fungi.

Exemplary Embodiment 6

Exemplary embodiment 6 presents a self-disinfecting drain trap in the form of a customary swan neck siphon with minimum instrumentation that is equipped with ultrasound 3, heating 6 and insulation 11.

Figure 4A:
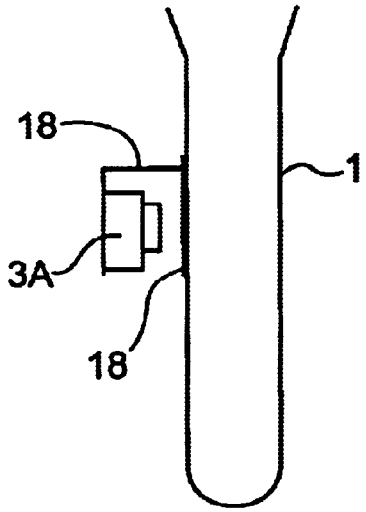
FIG. 4A shows the electromagnet positioned on the drain trap.

In this example as shown in FIG. 4A the ultrasound transmitter 3 is attached by means of a holder 18 to the side wall of the drain trap 1.

Exemplary Embodiment 7

Exemplary embodiment 7 (not shown in the figures) represents a self-disinfecting drain trap in the form of a customary bottle siphon with minimal instrumentation like embodiment 6 in which the heating consists of a heating lamp extending into the confining liquid.

Exemplary Embodiment 8

Exemplary embodiment 8 (not shown in the figures) represents a self-disinfecting drain trap in the form of a customary bottle siphon with minimal instrumentation in which the siphon body is manufactured from material permeable to radiation of light and the heating takes place by a heating lamp attached outside of the drain trap.

All U.S. patents mentioned hereinabove are incorporated herein by reference in their entirety.

What is claimed is:

1. Self-disinfecting drain trap device suitable for use in a drain channel, which device automatically self-cleans and self-disinfects during normal usage without interrupting its operation as a drain trap, which device comprises a drain trap;

a confining liquid contained in the drain trap;

at least one acoustic irradiation and oscillating system that operates when the temperature of the confining liquid is at least 50° C.; and at least one heating system for heating the interior of the drain trap.

2. The self-disinfecting drain trap according to claim 1, wherein the self-cleaning and self-disinfecting is intermittent.

3. The self-disinfecting drain trap device according to claim 1, wherein the self-cleaning and self-disinfecting is continuous.

4. The self-disinfecting drain trap device according to claim 1, wherein the acoustic irradiation and oscillating system generates low-frequency oscillations in the confining liquid.

5. The self-disinfecting drain trap device according to claim 4, wherein irradiation of air space above the confining liquid is regulated with short-wave light or ultraviolet light, the source of which is provided in a gas chamber above the confining liquid, within the confining liquid, or on the gas-liquid boundary surface.

6. The self-disinfecting drain trap device according to claim 1, which further comprises at least one temperature measuring sensor.

7. The self-disinfecting drain trap device according to claims 1, which further comprises at least one level measuring sensor.

8. The self-disinfecting drain trap device according to claim 1, which further comprises at least one temperature measuring sensor, wherein the acoustic irradiation and oscillating system, the heating system, and the at least one temperature measuring sensor, are positioned at least partially inside the drain trap.

9. The self-disinfecting drain trap device according to claim 1, which further comprises at least one temperature measuring sensor, wherein the acoustic irradiation and oscillating system, the heating system, and the at least one temperature measuring sensor, are positioned at least partially outside the drain trap.

10. The self-disinfecting drain trap device according to claim 1, which further comprises a mechanical closure device that closes and opens a pipeline opening, which mechanical closure device operates in conjunction with irradiation, regulating temperature of the confining liquid, and/or radiation with light.

11. The self-disinfecting drain trap device according to claim 1, which further comprises a mechanical closure device that closes and opens a pipeline opening, which mechanical closure device comprises a closure membrane that separates air space above the sealing liquid from air space in and above the pipeline opening.

12. The self-disinfecting drain trap device according to claim 1, characterized in that the drain trap is made of a material that prevents or reduces the adhesion of dirt and microorganisms.

13. The self-disinfecting drain trap device according to claim 1, characterized in that the interior surface and the surface of an inlet is coated with a coating that prevents or reduces the adhesion of dirt and microorganisms.

14. The self-disinfecting drain trap device according to claim 1, characterized in that the interior surface of the drain trap is coated with a germ-inhibiting or germicidal coating.

* * * * *